US005490800A

United States Patent [19]

Benes et al.

[11] Patent Number: 5,490,800

[45] Date of Patent: Feb. 13, 1996

[54] ELECTRICAL CONNECTOR

[75] Inventors: Kevin C. Benes, Willowbrook; Stephen A. Colleran, Lisle; Robert J. Gugelmeyer, Naperville; Thomas G. Premo, Downers Grove, all of Ill.

[73] Assignee: Molex Incorporated, Lisle, Ill.

[21] Appl. No.: 273,578

[22] Filed: Jul. 11, 1994

[51] Int. Cl.[6] ..... H01R 13/73

[52] U.S. Cl. ..... 439/567; 439/682

[58] Field of Search ..... 439/557, 558, 439/567, 571, 572, 682

[56] References Cited

U.S. PATENT DOCUMENTS

| | | | |
|---|---|---|---|
| 3,384,865 | 5/1968 | Bosworth | 439/174 |
| 3,621,444 | 11/1971 | Stein | 439/733.1 |
| 4,173,387 | 11/1979 | Zell | 439/557 |
| 4,220,808 | 9/1980 | Fujita | 439/557 |
| 4,477,142 | 10/1984 | Cooper et al. | 439/575 |
| 5,232,382 | 8/1993 | Karlovich | 439/843 |

FOREIGN PATENT DOCUMENTS

| | | | |
|---|---|---|---|
| 3146874 | 6/1983 | Germany | 439/557 |

*Primary Examiner*—Gary F. Paumen

*Attorney, Agent, or Firm*—A. A. Tirva

[57] ABSTRACT

An electrical connector is disclosed for mating with a dashboard mounted speedometer assembly that includes a housing with a plurality of terminal pins projecting therefrom. A plurality of elongated terminals each have a resiliently expandable socket portion at one end for receiving one of the terminal pins of the speedometer assembly, a terminating portion at the opposite end for interconnection with circuitry on a printed circuit board, and an intermediate portion between the ends. A dielectric housing has a mating face and a board mounting face with a plurality of through terminal-receiving passages extending between the faces. Each passage includes a cavity portion for receiving the socket portion for one of the terminals and an intermediate portion for receiving the intermediate portion of the terminal, with the terminating portion of the terminal projecting from the board mounting face of the housing. The cavity portion is sized to provide anti-overstress for the resiliently expandable socket portion of the terminal. A plurality of boardlock pegs project from the housing for insertion into mounting holes in the printed circuit board to mount the connector to the board. Each boardlock peg includes a guiding portion for guiding the peg into a respective one of the mounting holes in the printed circuit board, and a resilient latch portion for latching engagement with the board.

16 Claims, 3 Drawing Sheets

ELECTRICAL CONNECTOR

FIELD OF THE INVENTION

This invention generally relates to the art of electrical connectors and, particularly, to an electrical connector for mating with a dashboard mounted speedometer assembly to establish an electrical connecting interface between the speedometer assembly and another electrical device such as a printed circuit board.

BACKGROUND OF THE INVENTION

Electrical connectors have a wide range of applications and typically include a dielectric housing mounting a plurality of conductive terminals for establishing an electrical connecting interface between a pair of electrical components, circuits or devices. Electrical connectors are used quite extensively in automotive or other vehicular applications.

For instance, electrical connectors are used for electrically connecting various control or indicating devices mounted on a dashboard of an automobile or other vehicle, with a complementary electrical device such as a printed circuit board. Specifically, an analog speed indicating device or other speedometer assembly is mounted on or within the dashboard. The speedometer assembly is housed in a cylindrical can that has a plurality (four) cylindrical terminal pins projecting therefrom. A receptacle-type electrical connector is used for mating with the pins of the speedometer assembly and interconnecting the assembly to a printed circuit board which is part of the vehicular dashboard assembly. The connector includes four blade-like terminals which have mating ends for connection to the terminal pins of the speedometer assembly and terminating ends for connection to the printed circuit board. The terminals are stamped and formed of sheet metal material. The mating end of each terminal is formed by an aperture with flexible tabs adapted to receive and establish a mechanical and electrical connection with a pin of the speedometer assembly. The terminating end of each terminal is formed by a solder tail for insertion into a hole in the printed circuit board. The terminals are insert-molded on the dielectric housing of the connector. The connector typically has a pair of bubble-type boardlock pegs for securing within mounting holes in the printed circuit board.

Electrical connectors of the character described above have several disadvantages. First, the number and structure of the bubble-type boardlock pegs do not provide for a steady mounting of the connector to the printed circuit board, and the pegs are not conducive for guiding the tail portions of the terminals into their holes in the printed circuit board. Second, there is no overstress protection for the mating portion of the terminal. Consequently, a set often develops in the stamped and formed metal material of the terminal, and the electrical connection deteriorates with time especially if the connector is subjected to numerous mating and unmating cycles. Third, overmolding the terminals on the connector housing requires additional processing steps which significantly increases the manufacturing cost of the connector.

The present invention is directed to solving the above problems and eliminating the disadvantages presently inherent in the typical receptacle connectors that interface speedometer assemblies with other electrical devices such as printed circuit boards.

SUMMARY OF THE INVENTION

An object, therefore, of the invention is to provide a new and improved electrical connector of the character described above.

In the exemplary embodiment of the invention, an electrical connector is disclosed for mating with a dashboard mounted speedometer assembly that includes a housing with a plurality of terminal pins projecting therefrom. However, such an electrical connector can have other applications, particularly for electrically interfacing terminal pins with a complementary electrical device such as a printed circuit board.

The exemplary connector includes a plurality of elongated terminals each having a resiliently expandable socket portion at one end for receiving one of the terminal pins of the speedometer assembly. A terminal portion is provided at the opposite end for interconnection with circuitry on a printed circuit board, such as a solder tail for insertion into a hole in the board. An intermediate portion extends between the socket portion and the terminating portion. A dielectric housing includes a mating face and a board mounting face with a plurality of through terminal-receiving passages extending between the faces. Each passage includes a cavity portion for receiving the socket portion of one of the terminals and an intermediate portion for receiving the intermediate portion of the terminal, with the terminating portion of the terminal projecting from the board mounting face of the housing. The cavity portion of each passage is sized to provide an anti-overstress means for the resiliently expandable socket portion of the terminal.

A plurality of boardlock pegs project from the board mounting face of the housing for insertion into mounting holes in the printed circuit board to mount the connector to the board. Each boardlock peg includes a guiding portion for guiding the peg into a respective one of the mounting holes in the printed circuit board and a resilient latch portion for latching engagement with the board.

As disclosed herein, the boardlock pegs are generally hollow and in line with the cavity portions of the terminal-receiving passages. The generally hollow boardlock pegs are provided with side wall sections defining the guiding portions and the resilient latch portions of the pegs. Four of the boardlock pegs are provided in a generally rectangular array, with the guiding portions being at peripheral outside locations of the array.

In the preferred embodiment of the invention, the intermediate portions of the terminals are provided by generally flat, elongated blade-like sections. The socket portions of the terminals are offset from the elongated blade-like intermediate portions. The terminating portions comprise solder tails for insertion into appropriate holes in the printed circuit board. The socket portions include arcuate spring arms to define a resiliently expandable structure. The terminals are stamped and formed of sheet metal material.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
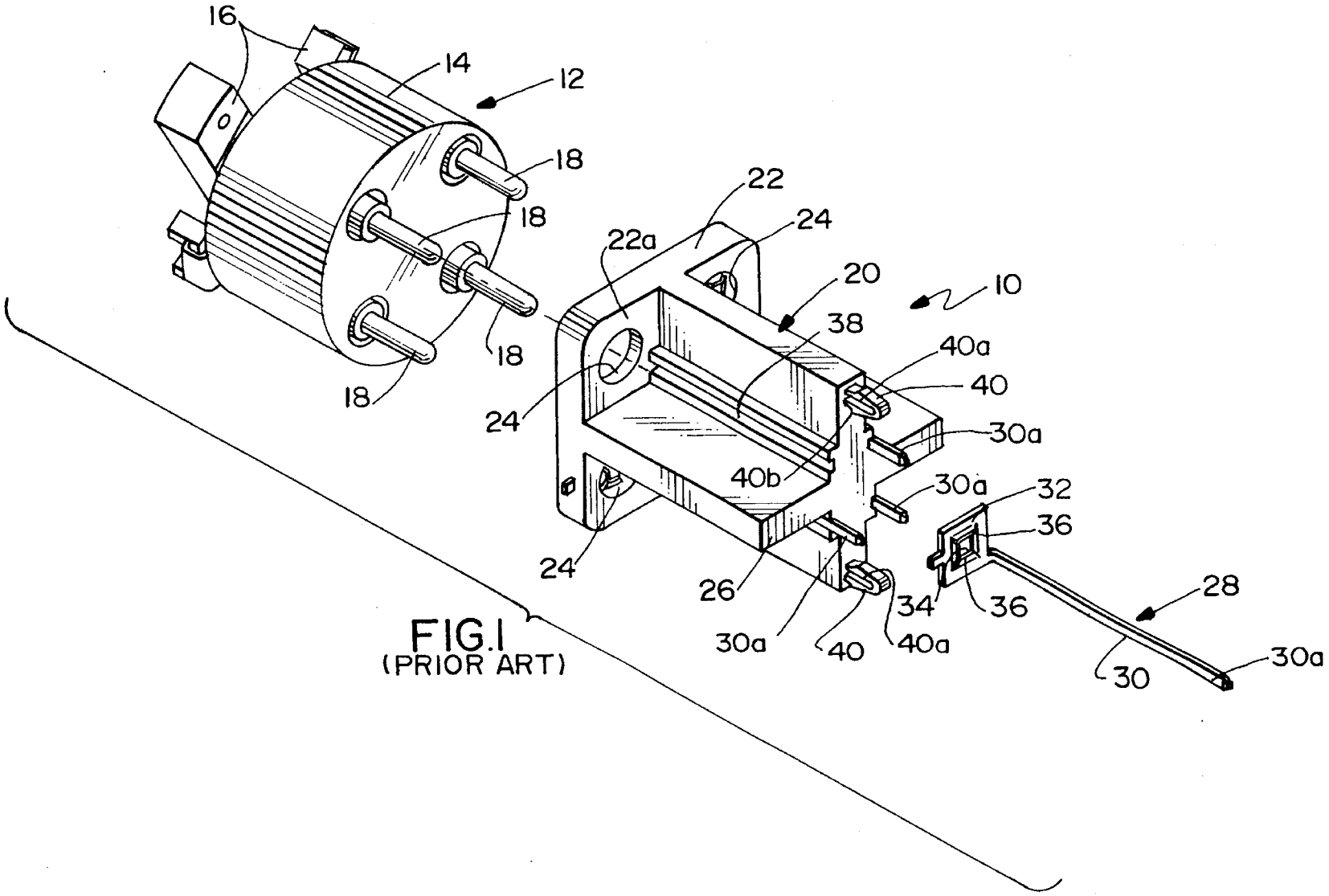
FIG. 1 (PRIOR ART)
FIG. 1 is an exploded perspective view of an electrical connector of the prior art in conjunction with a dashboard mountable speedometer assembly.

Referring to the drawings in greater detail, and first to FIG. 1, an electrical connector, generally designated 10, of the prior art is shown in conjunction with a dashboard mountable speedometer assembly, generally designated 12. The speedometer assembly is an analog speed indicating device which is housed in a cylindrical can 14 having a diameter of approximately one inch. Appropriate mounting means 16 are provided for mounting the speedometer assembly on or within a dashboard assembly of an automobile or other vehicle. Electrical connections to the speedometer assembly located within can 14 are established by four cylindrical terminal pins 18 projecting from the can. Each pin projects approximately one-half inch from the can, and each pin has a diameter of approximately 3/32 inch.

Prior art electrical connector 10 includes a cross-shaped dielectric housing 20 having a mating face defined by a flange 22 that includes four holes 24 through which terminal pins 18 of the speedometer assembly extend. The cross-shaped housing has a board mounting face 26 for mounting flush with one side of a printed circuit board (not shown). Four terminals, generally designated 28, are mounted on housing 20 of connector 10. Each terminal is stamped and formed of sheet metal material and includes a blade-like portion projecting perpendicularly away from a flange portion 32. An aperture 34 is formed in flange portion 32, and the aperture is bounded by flexible tabs 36.

Terminals 28 of prior art electrical connector 10 are mounted on the cross-shaped housing 20 by overmolding blade-like portions 30 of the terminals within grooves 38 of the housing, such that distal ends 30*a* of the blade-like portions project from board mounting face 26 of the housing. The projecting distal ends 30*a* form solder tails for insertion into holes in the printed circuit board whereby the tails can be soldered to circuit traces on the board and/or in the holes. When the terminals are overmolded in position on the dielectric housing, the flange portions 32 of the terminals abut against a rear face 22*a* of flange 22 of the housing.

In order to mount prior art connector 10 to the printed circuit board, a pair of conventional bubble-type boardlock pegs 40 project from board mounting face 26 of dielectric housing 20. Each boardlock peg includes an interior slot 40*a* to provide resiliency for the peg, and each peg includes outside ribs 40*b* for latching the peg to the printed circuit board. When the pegs are inserted into appropriate mounting holes in the printed circuit board, the sides of the pegs collapse during insertion and springback when fully inserted.

When prior art connector 10 is mated with speedometer assembly 12, terminal pins 18 are inserted through holes 24 in the dielectric housing of the connector and through apertures 34 in flange portions 32 of terminals 28. The flexible tabs 36 that bound apertures 34 grip terminals pins 18 to establish a mechanical and electrical connection therewith.

As stated in the "Background", above, there are several disadvantages or inherent problems with prior art connector 10. First, bubble-type boardlock pegs 40 do not provide proper means for guiding solder tail portions 30*a* of the terminals into their respective holes in the printed circuit board. The bubble-type pegs collapse upon insertion into their mounting holes and do not provide sufficient rigidifying guidance for the connector and the solder tails. In addition, simply providing two boardlock pegs makes the mounting of the connector to the board unsteady. Second, there is no anti-overstress means between the terminating portion of terminals 28 and terminal pins 18 of the speedometer assembly. Flexible tabs 36 of the terminals develop a set during repeated mating and unmating cycles, destroying their resiliency. Consequently, the electrical connection between the connector terminals and the terminal pins of the speedometer assembly deteriorate with time and mating cycles. Third, by overmolding the terminals on connector housing 20, additional processing steps are required that significantly increase the manufacturing cost of what otherwise should be a very simple and inexpensive electrical connector. The present invention is directed to overcoming all of these disadvantages and/or problems by providing a simple and very effective electrical connector, as described below, for mating with a typical speedometer assembly such as shown by speedometer assembly 12 in FIG. 1.

Figure 2:
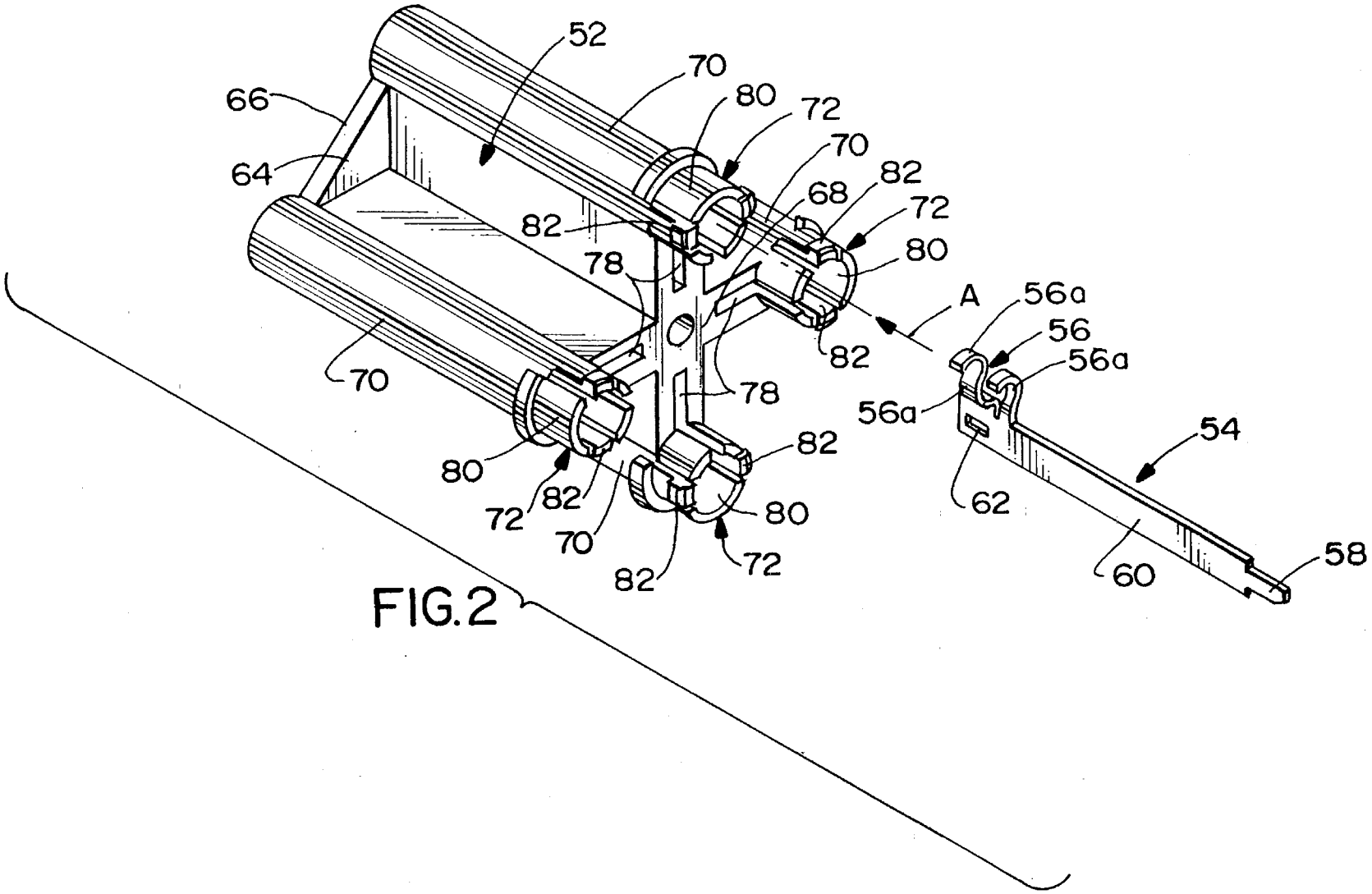
FIG. 2 is a perspective view of the electrical connector of the invention, the depiction showing only one of the four terminals.

Referring to FIG. 2, the concepts of the present invention are embodied in an electrical connector, generally designated 50, which includes a cross-shaped dielectric housing, generally designated 52, for mounting four elongated terminals, generally designated 54, that establish electrical connection between terminal pins 18 (FIG. 1) of speedometer assembly 12 and a printed circuit board. Only one terminal 54 is shown in FIG. 2 in order to avoid cluttering the depiction of housing 52.

Each terminal 54 is stamped and formed of sheet metal material and includes a resiliently expandable socket portion, generally designated 56, at one end for receiving one of the terminal pins 18. A terminating portion 58 is formed at the opposite end of each terminal for interconnection with circuitry on a printed circuit board. As shown, terminating portion or end 58 is in the form of a solder tail for insertion into a hole in the printed circuit board and for soldering to a circuit trace on the board and/or in the hole. A generally flat, elongated blade-like intermediate portion or section 60 joins socket portion 56 and terminating portion 58. It can be seen that the socket portion is offset relative to the intermediate portion, and the terminating portion is in line with the intermediate portion in the elongated direction of the terminal. Socket portion 56 is formed by arcuate spring arms 56*a* which define a resiliently expandable, cylindrical configuration of the socket portion. Lastly, a cantilevered latch tab 62 is formed out of the terminal for latching engagement with the material of the dielectric housing.

Still referring to FIG. 2, dielectric housing 52 of electrical connector 50 is a one-piece structure unitarily molded of plastic material. The housing has a flange 64 at one end thereof for defining a mating face 66, with a board mounting face 68 at the opposite end of the housing. The cross-shaped dielectric housing includes four silos 70 which define an overall square or rectangular configuration for the housing. A boardlock peg, generally designated 72, projects from board mounting face 68 of the housing at the adjacent end of each silo 70.

Figure 3:
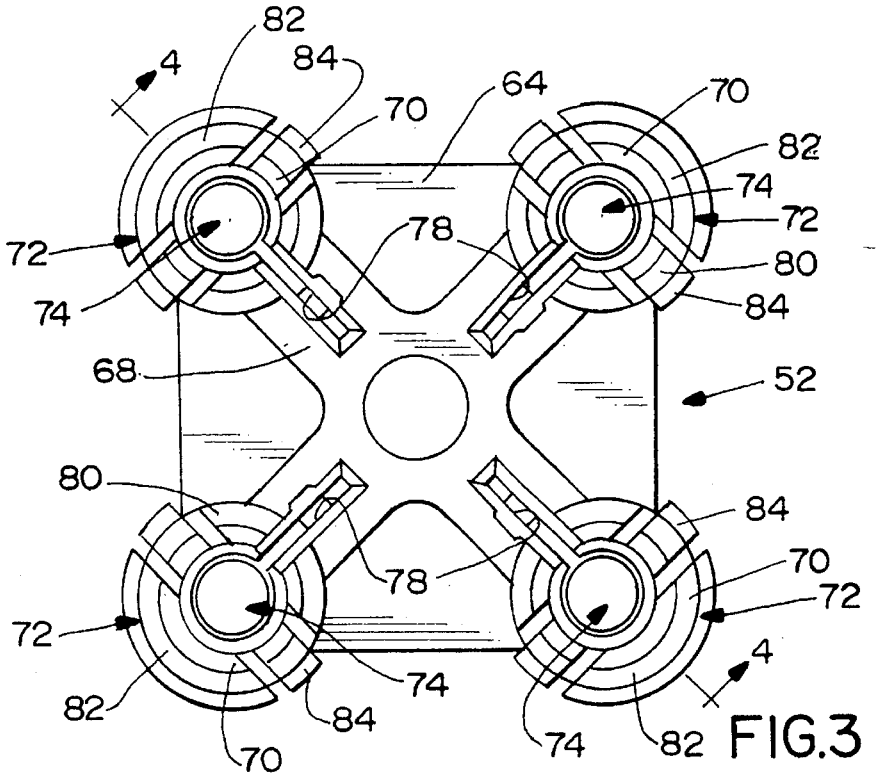
FIG. 3 is a plan view of the board mounting face of the connector housing.
Figure 4:
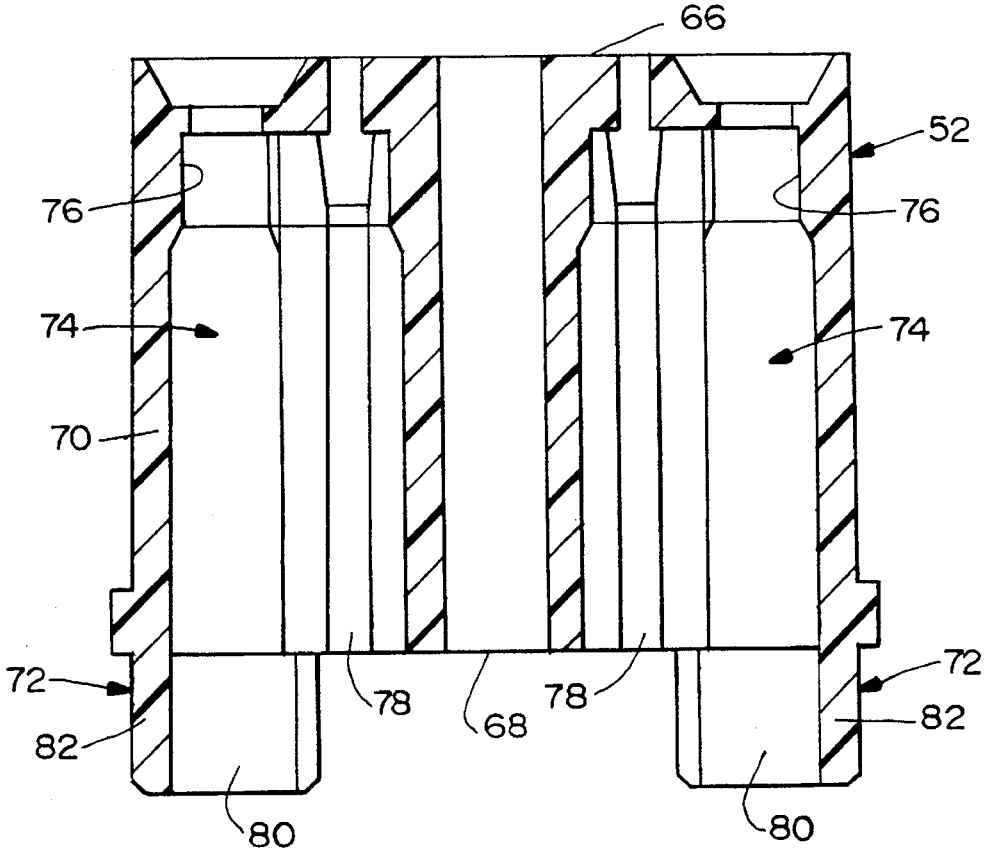
FIG. 4 is a section taken generally along line 4—4 of FIG. 3.

Referring to FIGS. 3 and 4 in conjunction with FIG. 2, a terminal-receiving passage, generally designated 74, extends entirely through dielectric housing 52 between mating face 66 and board mounting face 68, and within each silo 70. Each passage 74 includes a cavity portion 76 for receiving socket portion 56 of one of the terminals 54. The cavity portion is slightly larger than the cylindrical configuration defined by spring arms 56*a* of socket portion 56 of the terminal to allow the spring arms to resiliently expand and grip a respective one of the terminal pins 18 of speedometer assembly 12. However, cavity portions 76 are sized to restrict expansion of the arcuate spring arms beyond a damaging extent and thereby provide an anti-overstress means for the resiliently expandable socket portions of the terminals.

As seen in FIGS. 3 and 4, intermediate portions 78 of passages 74 are offset inwardly relative to cavity portions 76 of the passages. This can be understood by comparing the overall configuration of the passages with the offset configuration of terminals 54 as described above. Therefore, when each terminal 54 is inserted into its respective passage 74, in the direction of arrow "A" (FIG. 2), the generally flat blade-like intermediate portion 60 of the terminal enters offset intermediate portion 78 of the respective passage 74, whereas socket portion 76 of the terminal is in line with cavity portion 76 of the passage and eventually becomes located within the cavity portion when the terminal is fully inserted into the housing. When fully inserted, terminating or solder tail portions 58 (FIG. 2) of the terminals project from board mounting face 68 of the housing for insertion into their respective holes in the printed circuit board.

Each boardlock peg 72 is designed not only for securing electrical connector 50 to the printed circuit board, but the boardlock pegs provide stable guiding means for mounting the connector to the board and guiding tail portions 58 of the terminals into their respective holes in the board. More particularly, each boardlock peg 72 is generally cylindrical and includes an outer side wall section 80 and a pair of side latch sections 82. Side wall sections 80 cover considerable arcs about the outside peripheries of the boardlock pegs to provide rigidifying guiding portions of the pegs to stabilize insertion of the pegs into their mounting holes in the printed circuit board. In essence, these guiding portions are at peripheral outside locations of the rectangular array of pegs and combine to guide tail portions 58 of terminals 54 into their respective holes in the printed circuit board. Latch sections 82 are narrower and provide resilient latch portions of the mounting pegs. The latch portions have hooks 84, as best seen in FIG. 4, for securely latching the connector to the circuit board, with the hooks latchingly engaging the opposite surface of the board.

Lastly, as best seen in FIG. 4, by providing the generally hollow boardlock pegs 72 in line with cavity portions 76 of passages 74, an uninterrupted passageway is established through the entire dielectric housing, between mating face 66 and board mounting face 68, through silos 70, to facilitate molding of the dielectric housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for mating with a dashboard mounted speedometer assembly that includes a housing with a plurality of terminal pins projecting therefrom, comprising:

a plurality of elongated terminals each having a resiliently expandable socket portion at one end for receiving one of said terminal pins of the speedometer assembly, a terminating portion at the opposite end for interconnection with circuitry on a printed circuit board, and an intermediate portion between said ends; and a dielectric housing having a mating face and a board mounting face with a plurality of through terminal-receiving passages extending between the faces, each passage including a cavity portion for receiving the socket portion of one of the terminals and an intermediate portion for receiving the intermediate portion of the terminal with the terminating portion of the terminal projecting from the board mounting face of the housing, the cavity portion being sized to provide an anti-overstress means for the resiliently expandable socket portion of the terminal, and a plurality of boardlock pegs for insertion into mounting holes in the printed circuit board to mount the connector to the board, each boardlock peg including a guiding portion for guiding the peg into a respective one of the mounting holes in the printed circuit board and a resilient latch portion for latching engagement with the board, said boardlock pegs being generally hollow and forming a continuation of the cavity portions of respective said passages.

2. The electrical connector of claim 1 wherein said boardlock pegs are generally hollow with side wall sections thereof defining said guiding portions and said resilient latch portions.

3. The electrical connector of claim 2, including four of said boardlock pegs in a generally rectangular array, with said guiding portions being at peripheral outside locations of the array.

4. The electrical connector of claim 1 wherein the intermediate portions of said terminals comprise generally flat, elongated blade-like sections.

5. The electrical connector of claim 4 wherein the socket portions of the terminals are offset from the elongated blade-like intermediate portions.

6. The electrical connector of claim 5 wherein the terminating portions of the terminals comprise solder tails for insertion into appropriate holes in the printed circuit board.

7. The electrical connector of claim 6 wherein said terminals comprises stamped and formed sheet metal components.

8. The electrical connector of claim 1 wherein the socket portions of said terminals include arcuate spring arms.

9. An electrical connector for mating with a dashboard mounted speedometer assembly that includes a housing with a plurality of terminal pins projecting therefrom, comprising:

a plurality of terminals each having a resiliently expandable socket portion at one end for receiving one of said terminal pins of the speedometer assembly, and a terminating portion at the opposite end for interconnection with a complementary electrical device; and a dielectric housing having a plurality of terminal-receiving passages each including a cavity portion for receiving the socket portion of one of the terminals, the cavity portion being sized to provide an anti-overstress means for the resiliently expandable socket portion of the terminal, and a plurality of mounting pegs for insertion into appropriate mounting holes of a substrate to mount the connector thereto, each mounting peg including a guiding portion for guiding the peg into a respective one of the mounting holes in the substrate and a resilient latch portion for latching engagement with the substrate, said boardlock pegs being generally hollow and forming a continuation of the cavity portions of respective said passages.

10. The electrical connector of claim 9 wherein said mounting pegs are generally hollow with side wall sections thereof defining said guiding portions and said resilient latch portions.

11. The electrical connector of claim 10 including four of said mounting pegs in a generally rectangular array, with said guiding portions being at peripheral outside locations of the array.

12. The electrical connector of claim 9 wherein the terminating portions of the terminals are offset from the socket portions of the terminals.

13. The electrical connector of claim 12 wherein said terminals comprises stamped and formed sheet metal components.

14. The electrical connector of claim 13 wherein the socket portions of said terminals include arcuate spring arms.

15. An electrical connector for mating with a complementary electrical device that includes a plurality of projecting terminal pins, comprising:

a plurality of terminals each having a receptacle portion for receiving one of said terminal pins of the complementary electrical device; and a dielectric housing having a mating face and a mounting face with a plurality of through terminal-receiving passages extending between the faces, each passage including a cavity portion for receiving the receptacle portion of one of the terminals, and a plurality of mounting pegs for insertion into mounting holes in a substrate, each mounting peg being generally hollow and forming a continuation of one of the through terminal-receiving passages, said mounting pegs being in line with the cavity portions of said passages, each mounting peg including a guiding portion for guiding the peg into a respective one of the mounting holes in the substrate and a resilient latch portion for latching engagement with the substrate.

16. The electrical connector of claim 15, including four of said mounting pegs in a generally rectangular array, with said guiding portions being at peripheral outside locations of the array.

* * * * *